United States Patent [19]

Osada et al.

[11] Patent Number: 5,066,893

[45] Date of Patent: Nov. 19, 1991

[54] DRIVING CIRCUIT FOR AN ELECTROLUMINESCENCE DEVICE

[75] Inventors: Masahiko Osada, Hekinan; Masumi Arai; Shigeyuki Akita, both of Okazaki, all of Japan

[73] Assignee: Nippon Soken, Inc., Nishio, Japan

[21] Appl. No.: 624,217

[22] Filed: Dec. 7, 1990

[30] Foreign Application Priority Data

Dec. 8, 1989 [JP] Japan ..... I 320308

[51] Int. Cl.[5] ..... G09G 3/10

[52] U.S. Cl. ..... 315/169.3; 315/169.1; 340/781

[58] Field of Search ..... 315/169.3, 169.4, 219, 315/307, 246; 340/781, 811, 766, 767, 768, 789, 783

[56] References Cited

U.S. PATENT DOCUMENTS 3,629,653 12/1971 Irwin ..... 314/169.3
4,845,489 7/1989 Hormel ..... 314/169.3 X
4,962,374 10/1990 Fujioka et al. ..... 340/781

FOREIGN PATENT DOCUMENTS 54-70785 6/1979 Japan .

*Primary Examiner*—Eugene R. LaRoche
*Assistant Examiner*—Ali Neyzari
*Attorney, Agent, or Firm*—Cushman, Darby & Cushman

[57] ABSTRACT

A driving circuit for an electroluminescence device including a plurality of driving electrodes provided on at least one electroluminescence layer, a common electrode oppositely arranged to the driving electrodes with the electroluminescence layers interposed therebetween and commonly conducted, a common voltage supplying unit for applying a common pulse voltage to the common electrode, a luminescence voltage supplying unit for supplying a luminescence pulse voltage to the driving electrodes, and a non-luminescence voltage supplying unit for supplying a non-luminescence pulse voltage to the driving electrodes, wherein a timing in which the voltage applied to the electro-luminescence layer is zero voltage at a leading edge or a trailing edge of a wave form of the common pulse voltage, is utilized so that all of the electroluminescence layer are discharged in synchronization with each other to prevent generation of a spike pulse, whereby electroluminescence with high brightness can be obtained.

5 Claims, 6 Drawing Sheets

DRIVING CIRCUIT FOR AN ELECTROLUMINESCENCE DEVICE

BACKGROUND OF THE INVENTION

1. Field of the Invention

The present invention relates to a driving circuit for an electroluminescence device and especially relates to a driving circuit in which the withstand voltage of an electroluminescence device can be improved to obtain superior luminescence with high brightness.

2. Description of the Related Art

A conventional electroluminescence device luminesces utilizing the luminous phenomenon caused by applying an electric field to a fluorescent base material such as zinc sulfide containing manganese or the like as a luminescence center.

A transparent type electroluminescence device is typically constructed with a transparent electrode made of indium tin oxide film (ITO) formed on a surface of a glass substrate by deposition. An insulating layer, a luminescence layer, another insulating layer, and a transparent electrode are formed on a surface of the ITO transparent electrode in turn by deposition.

When making a display panel 1 comprising seven segments utilizing electroluminescence devices as shown in FIG. 1, an electrode 11 arranged on one of the surfaces of an electroluminescence layer 13 is usually used as a common electrode in order to simplify the panel construction.

On the other hand, a plurality of other electrodes 12 are arranged on the surfaces of the electroluminescence layers opposite to the surface to which the electrode 11 is provided. Each of them serves as a driving electrode.

An equivalent circuit of an actual circuit of such an electroluminescence display panel 1 is shown in FIG. 2.

In the FIG. 2, the electroluminescence layers 13 existing between the common electrode 11 and each one of the driving electrodes 12 are capacitive load indicated as Ca to Cg.

The common electrode 11 is grounded through a wiring resistor RO.

Each driving electrode, i.e., segment electrode 12, is oppositely arranged to the common electrode 11 with one of the electroluminescence layers 13 (loads Ca to Cg) interposed therebetween and is connected to a driving circuit (not shown) through one of the wiring resistors Ra to Rg.

FIG. 2 shows a condition where the electroluminescence devices are driven. In this condition, each electroluminescence device is driven to luminesce with a positive voltage +V and a negative voltage −V which are intermittently and alternately applied to each of the driving electrodes.

Since the circuit constants of the driving circuits differ from each other, the phases of the driving voltages Vb and Vc applied to the electroluminescence devices rarely are completely synchronized with each other.

If the driving voltage Vb is delayed in phase as shown in FIG. 2, it remains at a certain level when the driving voltage Vc falls to 0 V.

FIG. 2 shows a condition where the driving voltage Vc rises from a negative voltage −V to 0 V. In this situation, an electric charge +Q in a surface of the electroluminescence layer 13 on which the common electrode 11 is arranged is discharged to other electroluminescence devices through the common electrode 11.

Since the resistivity of ITO film, frequently used for the transparent electrode, is extremely large compared with that of aluminum film or the like, the resistance of the resistor Ro is increased, so the potential of the common electrode 11 is increased, causing a spiked voltage exceeding the driving voltage in an electroluminescence device which is charged and luminesces.

For example, when the resistance of the resistor Ro is infinity, the spiked voltage generated in a circuit when a phase of only one of signals Va to Vg is advanced from phases of another signals, as shown in FIG. 2 becomes around eight-sevenths the driving voltage.

Therefore, a problem arises in that the level of the spiked voltage as explained above will be increased when all but one of electroluminescence devices are simultaneously discharged and extinguished. This leads to breakage of the electroluminescence devices.

This kind of problem will occur when the driving voltages are delayed in phase from each other and when switching the driving operation of the electroluminescence devices due to a display change.

From this point of view, it is conventionally required that a level of a rated driving voltage of an electroluminescence display panel be sufficiently reduced when the resistance of the resistor Ro is large.

Therefore, a problem arises in that a luminescent display having a high level of brightness cannot be obtained.

SUMMARY OF THE INVENTION

The object of the present invention is to overcome these problems in the conventional art and to provide a driving circuit for an electroluminescence device by which the electroluminescence device can be driven with sufficiently high voltage, thereby obtaining a superior luminescence with high brightness.

To attain the object of the present invention, there is provided a driving circuit for an electroluminescence device which includes a plurality of driving electrodes provided on at least one electroluminescence layer, a common electrode oppositely arranged to the driving electrodes with an electroluminescence layer interposed therebetween and commonly conducted, a common voltage supplying means for applying a common pulse voltage to the common electrode, a luminescence voltage supplying means for supplying a luminescence pulse voltage having an inverse phase to and a predetermined delayed time from the common pulse voltage to each one of the driving electrodes to discharge the electroluminescence layer during a predetermined time and to charge the same to luminesce in the rest of the time of the luminescence pulse voltage, and a non-luminescence voltage supplying means which operates alternately with the luminescence voltage supplying means for supplying a non-luminescence pulse voltage having approximately the same phase as that of the common pulse voltage to each one of the driving electrodes to discharge the corresponding electroluminescence layer to extinguish.

The driving circuit for an electroluminescence device of the present invention is further provided with a timing adjusting means for adjusting a time when a switching operation is carried out during a predetermined time in which no voltage is applied to any one of the electroluminescence layer, in which a contact formed between the driving electrode and the luminescence voltage supplying means is changed to a contact formed between the driving electrode and the non-luminescence voltage supplying means or vice versa.

DESCRIPTION OF THE PREFERRED EMBODIMENTS

Figure 1:
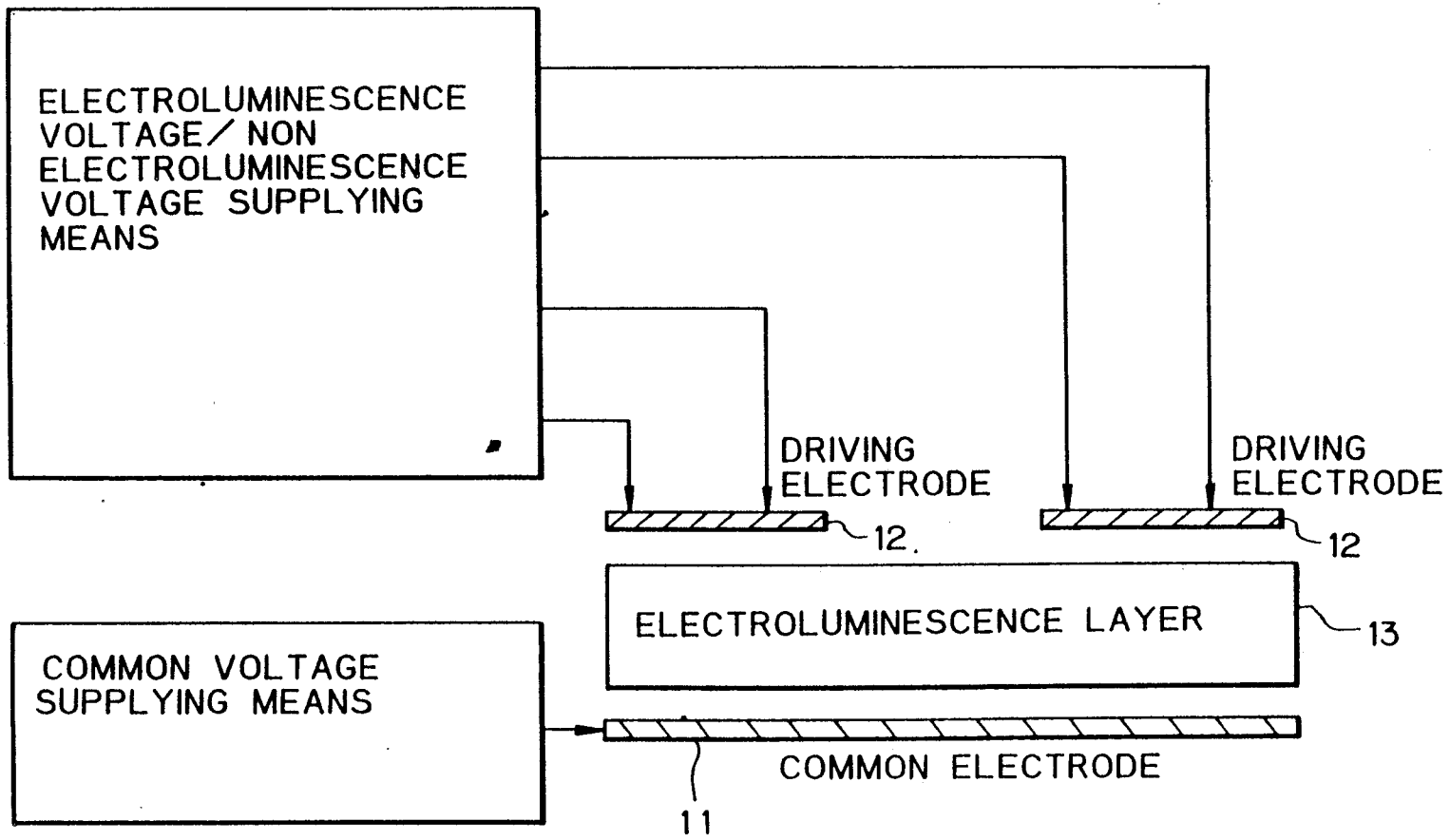
Fig. 1 (PRIOR ART)
FIG. 1 is a schematic view indicating a construction of a conventional electroluminescence device.

The preferred embodiments of the present invention will be explained hereunder with reference to the attached drawings.

As explained above and as shown in FIG. 3, the driving circuit 20 for an electroluminescence device of the present invention basically includes a plurality of driving electrodes 12 provided on at least one electroluminescence layer 13, a common electrode 11 oppositely arranged to the driving electrodes 12 with electroluminescence layers 13 interposed therebetween and being commonly conducted, a common voltage supplying means applying a common pulse voltage to the common electrode 11, a luminescence voltage supplying means for supplying a luminescence pulse voltage having an inverse phase to and a predetermined delay time from the common pulse voltage to each one of the driving electrodes 11 and for discharging the electroluminescence layer 13 in a predetermined time and for charging the same in the rest of the time to luminesce, and a non-luminescence voltage supplying means which operates alternately with the luminescence voltage supplying means for supplying a non-luminescence pulse voltage having approximately the same phase as that of the common pulse voltage to each one of the driving electrodes 12 to discharge the corresponding electroluminescence layer 13 to extinguish.

The driving circuit for an electroluminescence device 20 of the present invention is further provided with a timing adjusting means 2 for adjusting a time when a switching operation in which a contact of the driving electrode 12 to a luminescence voltage supplying means is changed to a contact thereof to a nonluminescence voltage supplying means, or vice versa, is carried out during the predetermined time in which no voltage is applied to any one of the electroluminescence layers.

In this circuit, a timing processing circuit 2 which serves as a timing adjusting means outputs a common pulse signal 2a, a luminescence pulse signal 2b a non-luminescence pulse signal 2c, and an authorization signal 2d.

Figure 4:
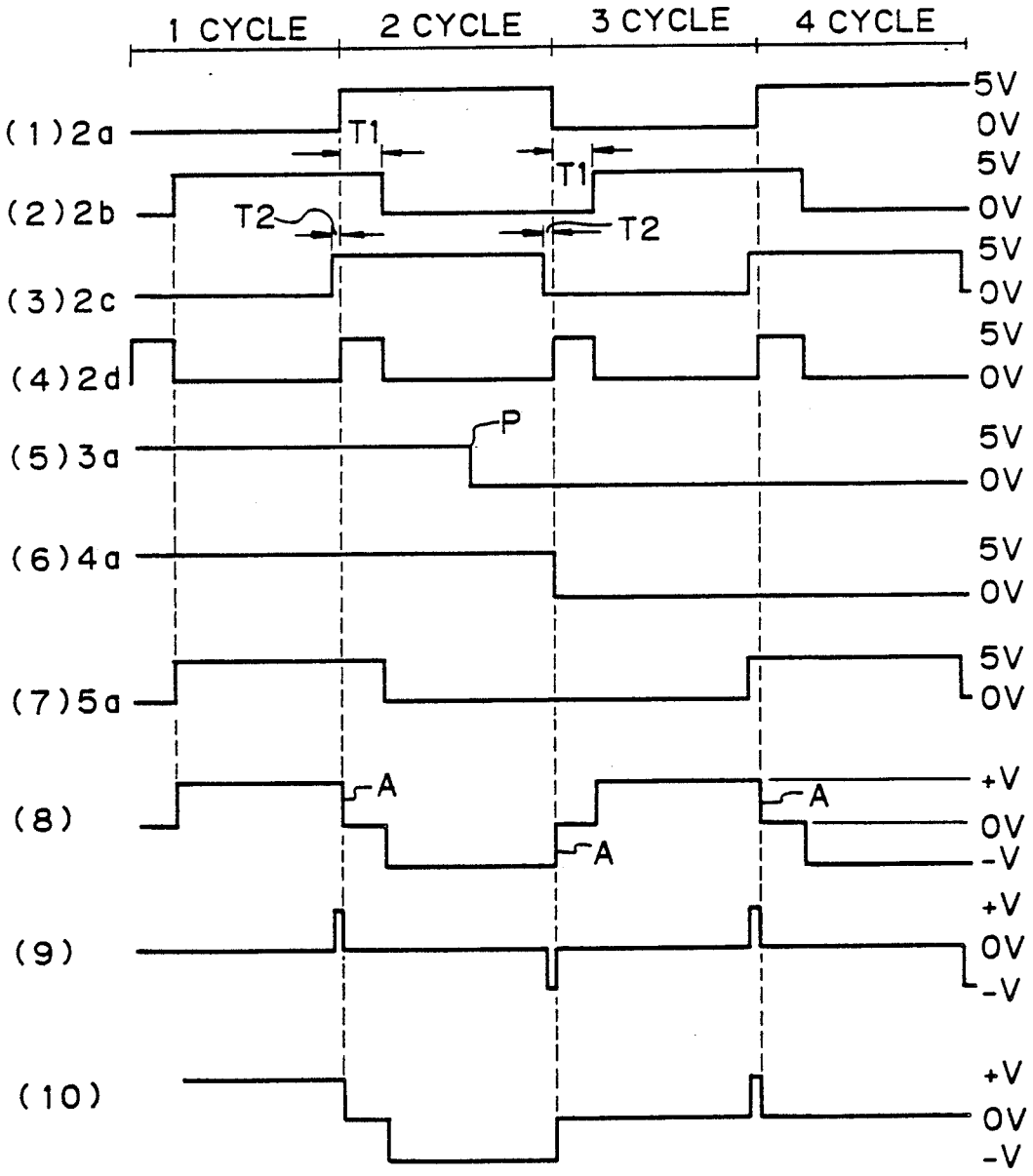
FIG. 4 is a timing chart indicating waveforms of signal outputs used in a circuit of one embodiment of the present invention as shown in FIG. 3.

The common pulse signal 2a is a rectangular pulse having a predetermined frequency, for example 5 KHz, indicated by a waveform (1) as shown in FIG. 4.

The luminescence pulse signal 2b is also a rectangular pulse having the same configuration as that of the common pulse signal 2a but having a phase inverse to that of the common pulse signal 2a and delayed therefrom by a predetermined time T1, for example 20 μs, indicated by a waveform (2) as shown in FIG. 4.

The non-luminescence pulse signal 2c is also a rectangular pulse having the same configuration and the same phase as that of the common pulse signal 2a but is slightly advanced to the common pulse signal 2a by a predetermined time T2, for example 2 μs, indicated by a waveform (3) as shown in FIG. 4.

The authorization signal 2d is a rectangular pulse which rises in synchronization with a leading edge of the common pulse signal 2a and descends in synchronization with a trailing edge of the luminescence pulse signal 2b as indicated by a waveform (4) as shown in FIG. 4.

A seven-segment output data processing circuit 3 has a conventional construction and outputs luminescing command signal pulses 3a to 3g to the seven output signal lines in order to display a desired symbol on a seven-segment electroluminescence display panel 1.

The command signal pulses 3a to 3g rise in voltage to a level of "1", for example, 5V, when light emission is commanded. One embodiment is shown by a waveform (5) of the command signal pulse 3a in FIG. 4.

A latch circuit 4 latches one of the command signal pulses 3a to 3g at a leading edge of the authorization signal 2d and holds it at a trailing edge of the authorization signal 2d.

An output signal 4a output from the latch circuit 4 is indicated as a waveform (6) with respect to the input signal 3a input to the latch circuit 4.

The output pulse signals 4a to 4g output from the latch circuit 4 are input to a data selecting circuit 5. The data selecting circuit 5 outputs the luminescence pulse signal 2b to the signal lines as output signals 5a to 5g when the output signals 4a to 4g from the latch circuit 4 are a level "1". The data selecting circuit 5 outputs the non-luminescence pulse signal 2c to the signal lines as output signals 5a to 5g when the output signals 4a to 4g are level "0".

Note that the data selecting circuit 5 outputs the luminescence pulse signal 2b to signal lines, for example, Sa and Sc, as the output signals 5a and 5c, respectively, when the output signals 4a and 4c from the latch circuit 4 are a level "1" while outputs the non-luminescence pulse signal 2c to the signal lines Sb and Sd to Sg as the output signals 5b and 5d to 5g, respectively, when the output signals 4b and 4d to 4g from the latch circuit 4 are a level "0".

A waveform (7) as shown in FIG. 4 shows an output pulse signal 5a output from the data selecting circuit 5 with respect to the input signal 4a input to the circuit 5.

In this embodiment, the driving circuit for the electroluminescence device is provided with high voltage output circuits 6A and 6B. A common pulse signal 2a is input to the high voltage output circuit 6A.

This high voltage output circuit 6A comprises an output portion including a conventional construction utilizing FETs 61 and 62.

In this circuit construction, when the common pulse signal 2a is at a voltage level of "1", a common pulse voltage having a positive voltage +V is applied to a common electrode 11 in the electroluminescence display panel 1.

When the common pulse signal 2a is at a voltage level of "0", a common pulse voltage having a negative voltage −V is applied to a common electrode 11 in the electroluminescence display panel 1.

Figure 2:
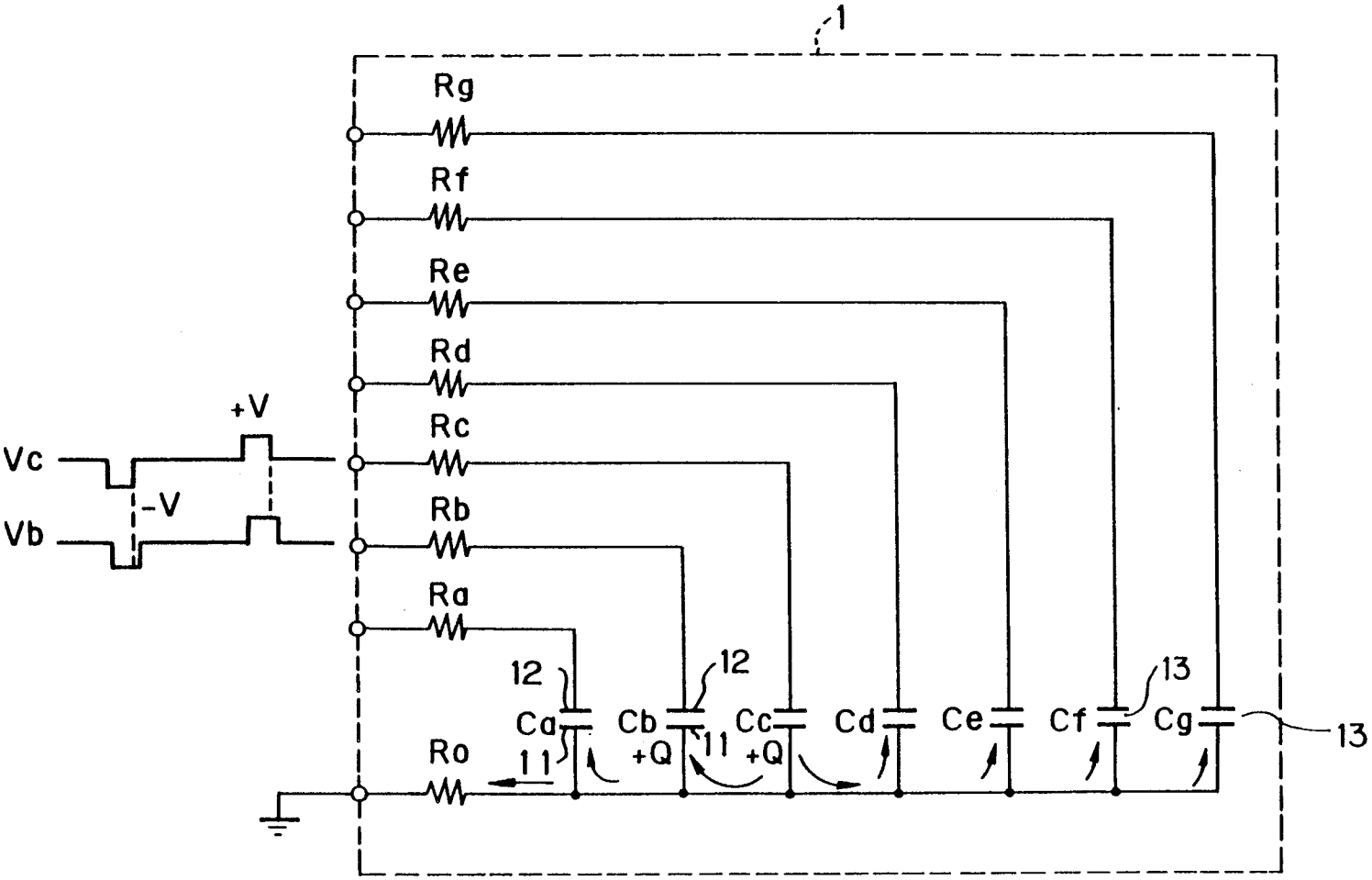
Fig. 2 (PRIOR ART)
FIG. 2 is an equivalent circuit of a conventional electroluminescence device.

In this embodiment, the voltage V is usually set at around 90V. The electroluminescence display panel 1 is similar in construction to that indicated in FIG. 2.

In the high voltage output circuit 6B, a plurality of high voltage output circuits 6Ba to 6Bg, each having the same circuit construction as that of the high voltage output circuit 6A, are provided with respect to the input signal lines 5a to 5g.

The high voltage output circuits provided in the high voltage output circuit 6B output pulse voltage signals to the signal lines Sa to Sg connected to the corresponding driving electrode 12.

Note that the high voltage output circuits 6Ba to 6Bg apply to the driving electrodes 12 of the electroluminescence layers 13 provided in the electroluminescence display panel, one of the luminescence pulse voltage signal, with voltages varied from a positive voltage +V to a negative voltage −V or non-luminescence pulse signal in accordance with a variation of a voltage signal level of the signals 5a to 5g.

The operation of the driving circuit of the present invention as mentioned above will be explained hereunder.

The command signals 3a to 3g are output from the output data processing circuit 3 in order to display a desired symbol on the electroluminescence display panel 1, then are input to the data selecting circuit 5 as input data 4a to 4g through a latch circuit 4 controlled by the timing of input of the authorization signal 2d output from the timing processing circuit 2.

The data selector 5 outputs to the high voltage output circuits 6Ba to 6Bg a luminescence pulse signal 2b when the input signal has a voltage level "1" and a non-luminescence pulse signal 2c when the input signal has a voltage level "0", as output signals 5a to 5g.

Thereafter, one of the luminescence pulse voltage including a positive voltage +V and a negative voltage −V or the non-luminescence pulse voltage is applied to the driving electrodes 12, corresponding to the voltage level of the input signal 5a to 5g, is output from the high voltage output circuits 6Ba to 6Bg in accordance with the voltage level of the signals 5a to 5g, respectively.

One example of the waveform of the output pulse signal from the high voltage output circuits 6Ba to 6Bg is shown by a waveform (8) in FIG. 4.

A common pulse voltage having both a positive voltage and a negative voltage with respect to a common pulse signal 2a input to the high voltage output circuit 6A is applied to the common electrode 11.

Therefore, a driving voltage having a waveform (8) as shown in FIG. 4 is applied to an electroluminescence layer which is driven by an electroluminescence pulse signal 2b (only an electroluminescence layer Ca is shown in FIG. 4), while a driving voltage having a waveform (9) as shown in FIG. 4 is applied to an electroluminescence layer which is driven by a non-electroluminescence pulse signal 2c.

In this situation, the times when the leading edge and the trailing edge of the luminescence pulse voltage generated from high voltage output circuits 6Ba to 6Bg in response to the luminescence pulse signal 2b occurs are different.

However, in the present invention, since the common pulse signal 2a is applied to the high voltage output circuit 6A and commonly applied to all segments through the resistor Ro, when the predetermined time T1 as mentioned above is set sufficiently longer than a time constant defined by an output impedance, a resistor Ro, and the sum of capacitances Ca to Cg in the high voltage output circuit 6A, the timing when the driving voltage returns to 0V (as shown as point A in the waveform (8) in FIG. 4) coincides in all electroluminescence layers.

Thus, discharge operations in all of the luminescing electroluminescence layers can be synchronized, whereby generation of a spike voltage having an excessive voltage is effectively prevented in the electroluminescence layers.

The driving voltage for electroluminescence layers driven by the non-luminescence pulse signal 2c is shown in the waveform (9) in FIG. 4. It has positive pulses and negative pulses each having a pulse width of T2 and alternatively generated in synchronization with a leading edge and a trailing edge of the common pulse signal 2a.

The capacitive electroluminescence layer, however, is not charged to luminesce by the non-luminescence pulse signal 2c due to the pulse width T2 of driving voltage for electroluminescence layers being sufficiently short and a delay caused by a time constant defined by an output impedance Ra of the high output voltage circuit 6B and a capacitance Ca of the layer.

The operation for extinguishing the luminescence of the electroluminescence layer Ca due to a display change will be explained hereunder.

When a signal level of the command signal 3a to cause the electroluminescence layer to luminesce is changed from "1" to "0" (as shown at a point P intermediate position of the second cycle of the common pulse signal 2a) this signal change is transmitted to the signal 4a at a time when the authorization signal 2d is input to the latch circuit 4.

Then, the output signal 5a is switched from the luminescence pulse signal 2b to the non-luminescence pulse signal 2c at the earliest stage of the third cycle of the common pulse signal 2a (as shown by a waveform (7) in FIG. 4).

Thus, the driving voltage for the electroluminescence layer Ca is also changed at the earliest stage of the third cycle of the common pulse signal 2a (as shown by waveform (10) in FIG. 4).

Figure 3:
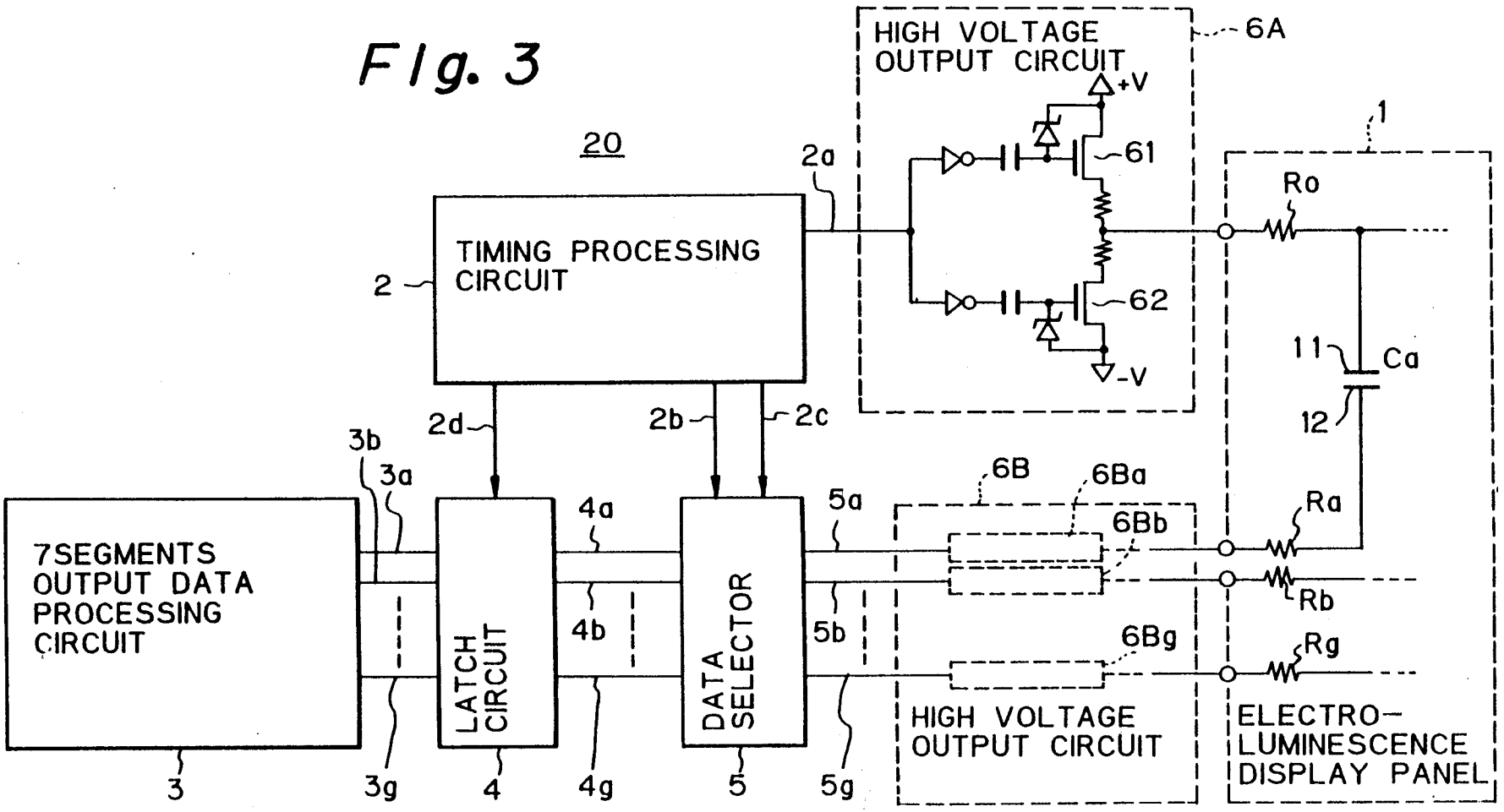
FIG. 3 is a block diagram of one embodiment of the present invention.
Figure 7:
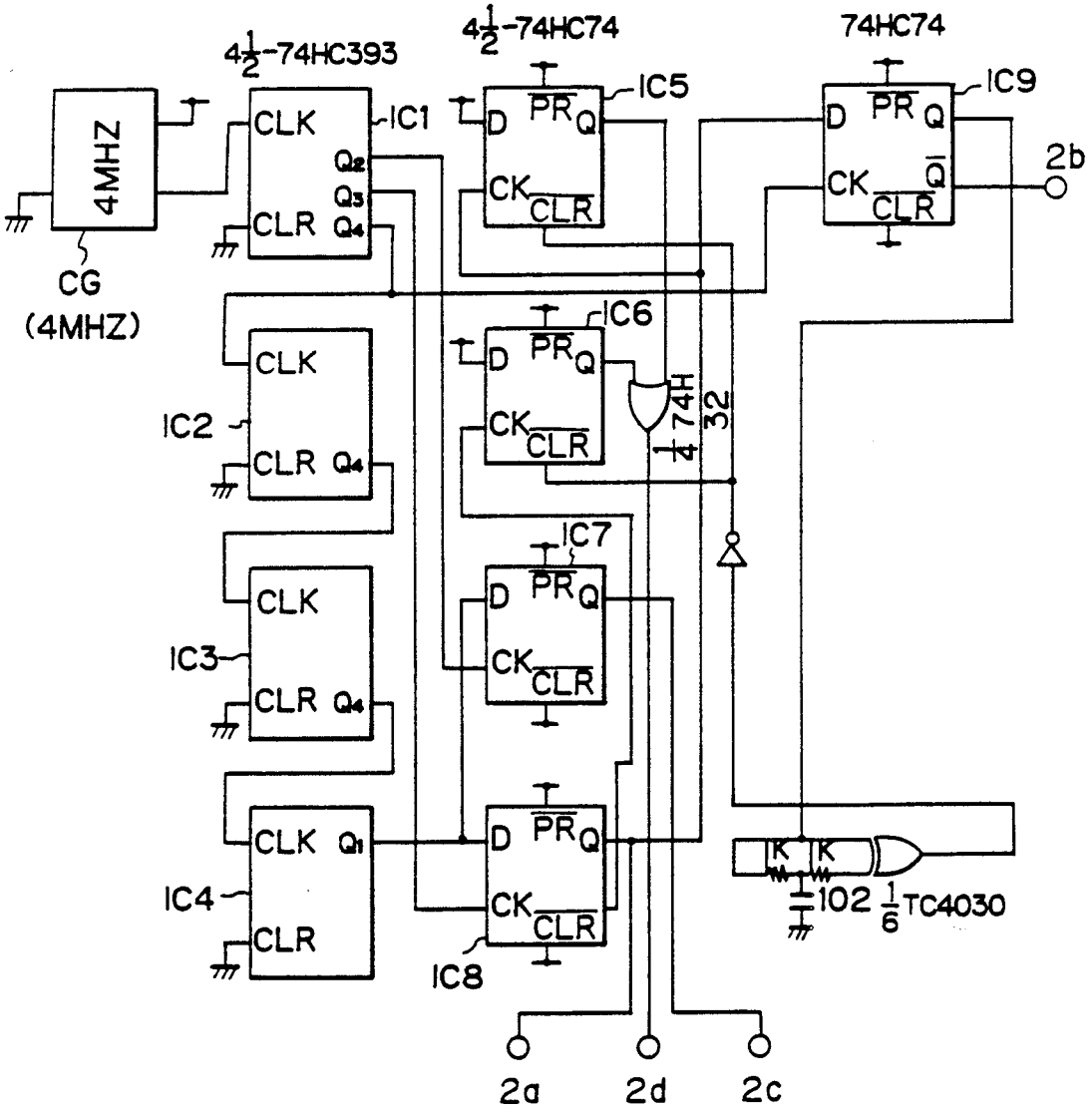
FIG. 7 is a block diagram of one embodiment of a timing processing circuit used in the present invention.

FIG. 7 is a block diagram indicating one embodiment of the timing circuit 2 actually used in FIG. 3.

In that, a common pulse signal 2a is obtained by dividing an original clock pulse having a frequency of 4 MHz generated from a clock generator CG through serially arranged counters IC1 to IC4 and by finally outputting from an output of a flip-flop IC8 in synchronization with an output Q3 of the IC1.

A non-luminescence pulse signal 2c is obtained from an output of a flip-flop IC7 by outputting the thus divided signal input thereto from the IC4 in synchronization with an output Q2 of the IC1.

In this embodiment, the phase of the non-luminescence pulse signal 2c is advanced against that of the common pulse signal 2a by 1 μsec (corresponding to a width T2 in FIG. 4).

A luminescence pulse signal 2b is obtained from an output of a counter IC9 by inversely outputting the common pulse signal 2a input thereto in synchronization with the output Q4 of the counter IC1.

In this embodiment, the phase of the luminascence pulse signal 2*b* is delayed against that of the common pulse signal 2*a* by 20 μsec and the phase thereof is reversed to that of the common pulse signal 2*a*, (corresponding to a width T1 in FIG. 4).

An authorization pulse signal 2*d* is turned to the voltage level "1" in response to a leading edge of the common pulse signal 2*a* caused by the counter IC5 or in response to a trailing edge of the common pulse signal 2*a* caused by the counter IC6 and is turned to the voltage level "0" in response to a leading edge of the luminescence pulse signal 2*b* or in response to a trailing edge thereof caused by a resetting operation of the counters IC5 and IC6 utilizing a complementary output to the luminescence pulse signal 2*b* through a circuit comprised, for example, of TC-4030.

A time duration T1 or T2 can be set voluntarily at any desired value by determining a frequency of an original clock and by selecting clock inputs of the counters IC7 to IC9 from output signals output from the counters IC1 to IC4.

Accordingly, in the present invention, the switching operation between a charging condition to luminesce and a discharging condition to extinguish of the electroluminescence layer Ca occurs in coinciding with the time when a discharging operation of the layer, continues for a predetermined time T1, starts in accordance with the authorization signal 2*d*.

Therefore, the generation of a spike voltage having an excessive voltage can be prevented when a display in the electroluminescence display panel is changed.

Figure 5:
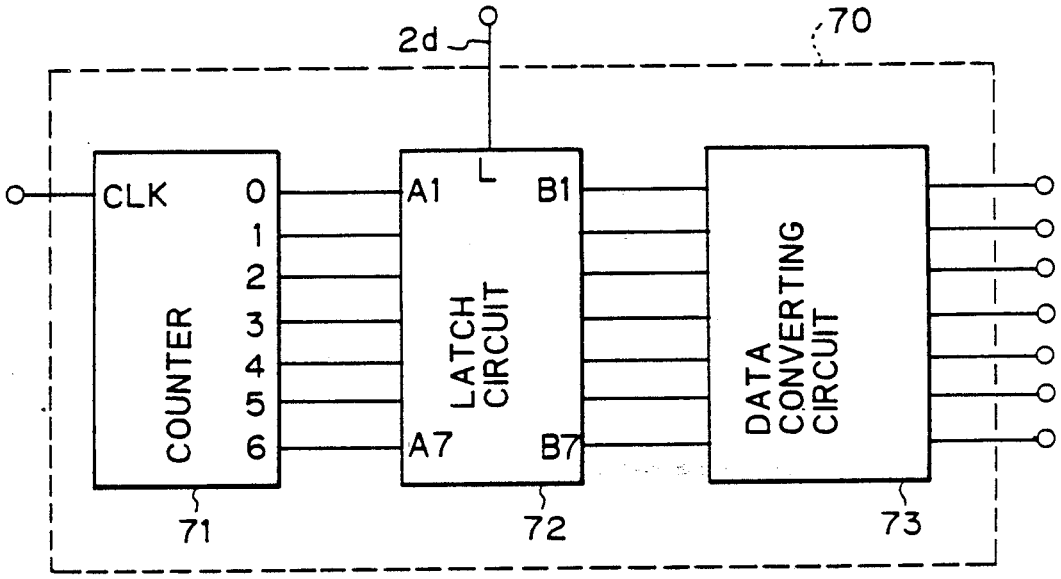
FIG. 5 is a block diagram indicating a circuit construction of another embodiment of the present invention.

When a time display is required in the electroluminescence display panel 1 in the above embodiment, as shown in FIG. 5, a clock counting circuit 70 including a clock counter 71 may be used. In this case, when the authorization signal 2*d* is applied to an enable input terminal of a latch circuit 72, which is generally included therein downstream of the clock counter 71, no other separate latch circuit is required.

Note that 73 denotes a data converting circuit for converting an output signal from the counter 71 to the seven-segment data.

Figure 6:
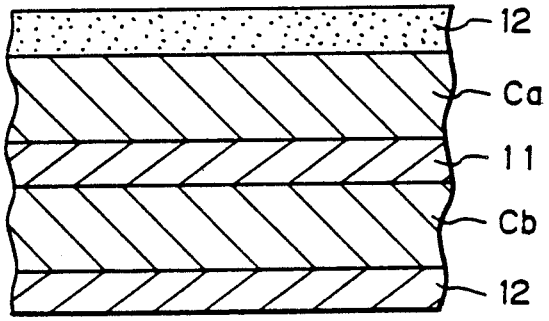
FIG. 6 is a cross-sectional view showing a construction of an electroluminescence device.

As shown in FIG. 6, the present invention can be applied to a driving system in a display device with a plurality of electroluminescence layers Ca, Cb, stacked on each other.

Note that, in this embodiment, a common pulse voltage is applied to a common electrode 11 interposed between electroluminescence layers Ca and Cb vertically stacked on each other. A luminescence pulse voltage or a non-luminescence pulse voltage may be applied to driving electrodes of the electroluminescence layer.

In the embodiment as explained above, both the common pulse signal and the electroluminescence pulse signal are rectangular pulse waves each having voltage levels of +V and −V.

A difference in the voltage level may be introduced into this rectangular pulse wave, for example, +V1 and −V2, however, the difference thereof must be set at a level lower than a threshold voltage level of the electroluminescence layer.

Note that the positive voltage and the negative voltage thereof need not be symmetrical to each other and need not be rectangular in waveform, but may be sinusoidal or sawtooth in waveform.

Further, the frequency thereof is not necessarily kept at a constant value.

The switching operation between the charging for luminescence and the discharging for extinguishing in the electroluminescence layers need not coincide with the time when the discharging operation for a predetermined time T1 starts, but may be carried out within the predetermined time T1.

The present invention is not restricted only to an electroluminescence layer having the segments as explained above and may clearly be applied to an electroluminescence display panel having a dot matrix system.

In accordance with an experimental test, it was found the rated driving voltage of the driving circuit of the present invention can be increased by about 16V with point estimation and by about 4 to 30V with area estimation, both with a significant level of 95%, compared with a conventional circuit.

Thus, in the present invention, an electroluminescence display with a high brightness can be realized.

In the circuit of the present invention, when the luminescence pulse voltage is applied to the driving electrodes from a plurality of luminescence voltage supplying means, the time when a luminescence pulse voltage which is actually applied to one of the electroluminescence layers rises or descends is difficult from that of other electroluminescence layers due to a difference of circuit constants therebatween.

In this situation, when the luminescence pulse voltage applied to the driving electrodes is reversed to have an inverse phase against the common pulse voltage which is applied to the common electrode and is delayed for a predetermined time, the electroluminescence layer is charged when the luminescence pulse voltage applied to the driving electrodes rises or descends, whereby the luminescence driving pulse voltage actually applied to the electroluminescence layer is forcibly changed to a sufficiently lowered voltage from a constant negative or positive voltage simultaneously with a time when the luminescence pulse voltage applied to the common electrode rises or descends.

Thus, all of the electroluminescence layers luminescing in the charged condition are discharged in synchronization with the common pulse voltage signal to avoid generation of a spike voltage having a large voltage level.

Further, when a non-luminescence voltage supplying means is actuated instead of actuating a luminescence voltage supplying means in order to change the display, the switching operation can be carried out utilizing the timing adjusting means as explained above exactly in a predetermined constant time. Therefore in the present invention, the driving circuit for the electroluminescence device does not generate a spike voltage having an excessive voltage when the electroluminescence layer is driven or the display in the display panes is changed, so the rated driving voltage can be significantly increased and an electroluminescence display with high brightness can be realized.

We claim:

1. A driving circuit for an electroluminescence device which comprises:

a plurality of driving electrodes provided on at least one electroluminescence layer;

a common electrode oppositely arranged to said driving electrodes with said electroluminescence layer interposed therebetween and commonly conducted;

a common voltage supplying means for applying a common pulse voltage to said common electrode;

a luminescence voltage supplying means for supplying a luminescence pulse voltage having an inversed phase to and a predetermined delay time from said common pulse voltage to said driving electrodes to discharge said electroluminescence layer during said predetermined delay time and to charge the same to luminesce in the rest of the time of said luminescence pulse voltage, and a non-luminescence voltage supplying means which operates alternately with said luminescence voltage supplying means for supplying a non-luminescence pulse voltage having approximately the same phase as that of said common pulse voltage to said driving electrodes to discharge said corresponding electroluminescence layer to extinguish.

2. A driving circuit for an electroluminescence device according to claim 1, wherein said device is further provided with a timing adjusting means for adjusting a time when a switching operation is carried out during said predetermined delay time in which no voltage is applied to any of said electroluminescence layers, in which a contact formed between the driving electrode and the luminescence voltage supplying means is charged to a contact formed between the driving electrode and the non-luminescence voltage supplying means or vice versa.

3. A driving circuit for an electroluminescence device according to claim 1, wherein said non-luminescence pulse voltage having approximately the same phase as that of said common pulse voltage is advanced on phase against said common pulse voltage.

4. A driving circuit for an electroluminescence device, which comprises;

a plurality of driving electrodes provided on a plurality of electroluminescence layers;

a common electrode oppositely arranged to said driving electrodes with said electroluminescence layers interposed therebetween;

a pulse signal generating means for generating a common pulse signal to apply a common pulse voltage to said common electrode, a luminescence pulse signal having an inverse phase to and a predetermined delay time from said common pulse signal, and a non-luminescence pulse signal having approximately the same phase as that of said common pulse signal;

a demanding means for demanding said plurality of said electroluminescence layers luminescence or not in order to display predetermined information on a display means;

a selecting means for selecting any one of said luminescence pulse signal and said non-luminescence pulse signal generated from said pulse signal generating means in response to said demand of luminescence or non-luminescence generated from said demanding means;

an output means for said common electrode for applying a common pulse voltage synchronized to said common pulse signal generated from said pulse signal generating means to said common electrode; and an output means for said driving electrode provided on each said driving electrode and said output means applying said pulse voltage synchronized to said signal selectively output from said selecting means to said driving electrodes.

5. A driving circuit for an electroluminescence device according to claim 4, wherein said electroluminescence layer is formed by stacking a plurality of unit electroluminescence layers on each other.

* * * * *